US011072895B2

(12) United States Patent
Matsudo et al.

(10) Patent No.: US 11,072,895 B2
(45) Date of Patent: Jul. 27, 2021

(54) METHOD FOR CORRECTING CONCRETE SLAB TILTING ON SUBSIDED GROUND

(71) Applicant: UPCON Corporation, Kawasaki (JP)

(72) Inventors: Nobukazu Matsudo, Kanagawa (JP); Koji Kawaguchi, Kanagawa (JP)

(73) Assignee: UPCON CORPORATION, Kawasaki (JP)

( * ) Notice: Subject to any disclaimer, the term of this patent is extended or adjusted under 35 U.S.C. 154(b) by 0 days.

(21) Appl. No.: 16/473,525

(22) PCT Filed: Dec. 27, 2017

(86) PCT No.: PCT/JP2017/047143
§ 371 (c)(1),
(2) Date: Jun. 25, 2019

(87) PCT Pub. No.: WO2018/124251
PCT Pub. Date: Jul. 5, 2018

(65) Prior Publication Data

US 2019/0323182 A1 Oct. 24, 2019

(30) Foreign Application Priority Data

Dec. 27, 2016 (JP) ..... JP2016-254476

(51) Int. Cl.
*E01C 11/02* (2006.01)
*E01C 23/10* (2006.01)
*E01C 11/14* (2006.01)

(52) U.S. Cl.
CPC ..... *E01C 23/10* (2013.01); *E01C 11/14* (2013.01)

(58) Field of Classification Search
CPC ..... E01C 23/10
(Continued)

(56) References Cited

U.S. PATENT DOCUMENTS 1,863,180 A * 6/1932 Adler ..... E01C 11/14 404/48
1,915,032 A * 6/1933 Poulter ..... E01C 23/10 404/78

(Continued)

FOREIGN PATENT DOCUMENTS

JP S63-032025 A 2/1988
JP H01-116195 A 5/1989

(Continued)

OTHER PUBLICATIONS

Office Action of New Zealand Patent Application No. 754801: First Examination Report dated Jan. 24, 2020 (3 sheets).

(Continued)

*Primary Examiner* — Thomas B Will
*Assistant Examiner* — Katherine J Chu
(74) *Attorney, Agent, or Firm* — Kratz, Quintos & Hanson, LLP

(57) ABSTRACT

A method for correcting the tilt of adjacent concrete slabs on subsided ground and connected at a joint part by tie bars or dowel bars caused by the subsidence of the joint part. The method comprises pushing up a tilted concrete slab by: drilling an injection hole for injecting an expandable resin in one concrete slab at a point 10 to 200 cm away from the joint part and also in the other concrete slab at a point 10 to 200 cm away from the joint part, the point in the other concrete slab being on a line that is orthogonal to the joint part and has the point in the one concrete slab thereon; and simultaneously starting an operation of intermittently injecting an expandable resin from both of the injection holes wherein the expandable resin expands below both of the concrete slabs.

4 Claims, 2 Drawing Sheets

(58) Field of Classification Search
USPC ..... 404/78
See application file for complete search history.

(56) References Cited

U.S. PATENT DOCUMENTS 2,074,756 A * 3/1937 Poulter ..... E01C 23/10 404/108
2,367,146 A * 1/1945 Siebs ..... E04B 2/84 264/34
4,240,995 A * 12/1980 Milne ..... E01C 23/10 264/36.2
4,470,719 A * 9/1984 Dziark ..... E01C 23/10 404/47
4,567,708 A * 2/1986 Haekkinen ..... E02D 35/00 52/742.13
4,659,748 A * 4/1987 Boddie ..... C08G 18/302 404/67
6,068,425 A * 5/2000 Fershtut ..... E01C 23/10 404/78
6,521,673 B1 * 2/2003 Brown ..... C08G 18/4804 404/78
6,558,071 B1 * 5/2003 Sproules ..... E01C 5/08 404/78
6,976,804 B1 * 12/2005 Asplin ..... E01C 23/10 404/78
8,186,907 B1 * 5/2012 Asplin ..... E01C 23/10 404/78
9,546,454 B2 * 1/2017 Sanders ..... E01C 7/147
9,556,566 B2 * 1/2017 Sanders ..... E01C 23/00
9,605,391 B1 * 3/2017 Ayala ..... E01C 11/005
9,676,425 B2 * 6/2017 Kanie ..... B62D 25/24
9,822,497 B2 * 11/2017 Doan ..... E04G 23/0203
10,006,174 B2 * 6/2018 Ulislam ..... E01C 11/04
10,047,534 B2 * 8/2018 Matsudo ..... E04G 23/0288
2014/0193197 A1 * 7/2014 Cvetezar ..... C08J 9/36 404/72
2017/0191227 A1 * 7/2017 Sylvester ..... E01C 5/08
2017/0321027 A1 * 11/2017 Van Horn ..... C08J 9/142

FOREIGN PATENT DOCUMENTS

JP 2006-144269 A 6/2006
JP 2010-126955 A 6/2010
JP 2010-236181 A 10/2010
JP 2014-051859 A 3/2014

OTHER PUBLICATIONS

International Search Report of the International Searching Authority for International Application No. PCT/JP2017/047143 dated Mar. 27, 2018 (3 sheets, 2 sheets translation, 5 sheets total).

* cited by examiner

Fig. 1A
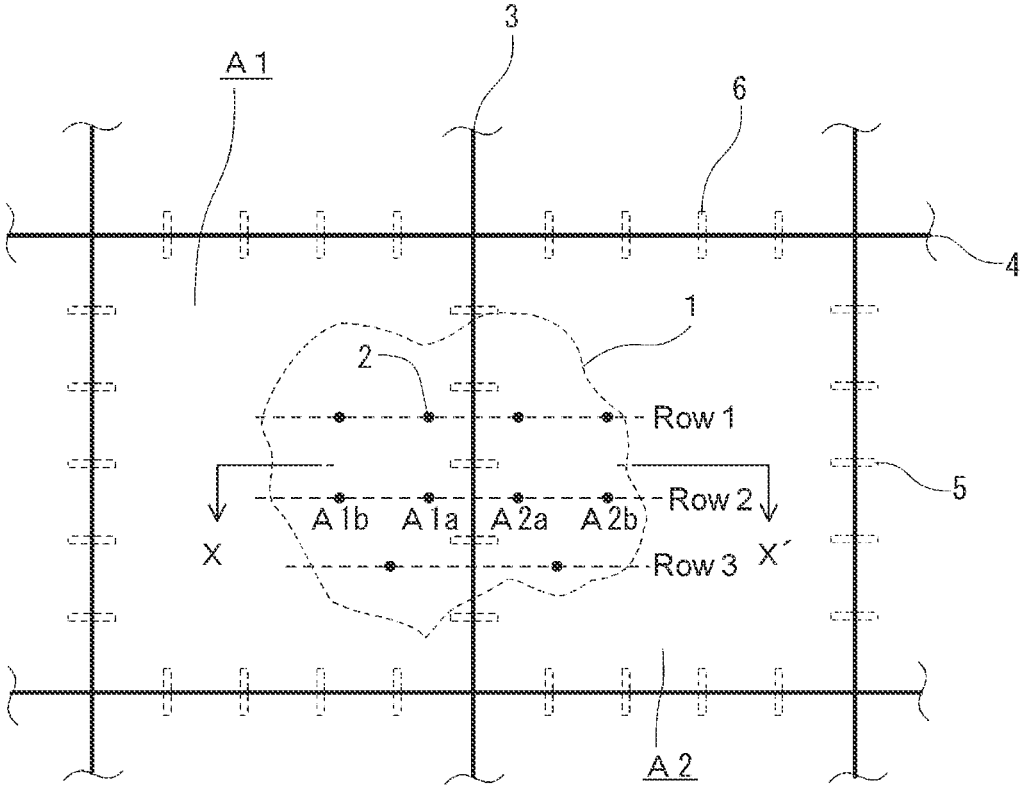
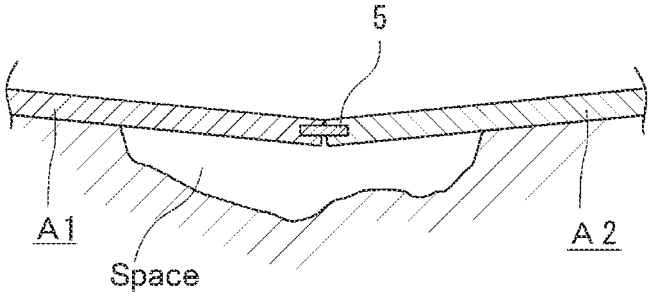
X-X' Cross-sectional view
Fig. 1B

METHOD FOR CORRECTING CONCRETE SLAB TILTING ON SUBSIDED GROUND

TECHNICAL FIELD

The present invention relates to a method for correcting the tilt of a concrete slab on subsided ground. More specifically, the present invention relates to a method for correcting, on subsided ground on a road, at a port or airport, or the like, the tilt of adjacent concrete slabs connected at a joint part by tie bars or dowel bars caused by the subsidence of the joint part.

BACKGROUND ART

In recent years, ground subsidence due to various causes has been affecting concrete slab pavement on roads, in ports, and in airports, or the like, resulting in problematic damages. Specifically, for example, when ground subsidence occurs due to the pumping of a large amount of underground water as factory water from a weak ground zone, the welling of a large amount of water resulting from the development of underground tunnels, insufficient compaction of soil on reclaimed land from the ocean or large-scale developed land, or the like, concrete slabs are tilted, which hinders the passage of automobiles or airplanes, causing an obstacle to the transportation of people and goods. As a method for dealing with such a problem, a method in which an expandable resin is injected from an injection hole drilled in a concrete slab into an inside of subsided ground or a space formed between the ground and the concrete slab, and the resin is expanded to push up the tilted concrete slab to a predetermined height, is known (e.g., Patent Document 1).

PRIOR ART DOCUMENTS

Patent Document

Patent Document 1: JP-A-2006-144269

SUMMARY OF THE INVENTION

Problems that the Invention is to Solve

According to the method utilizing an expandable resin described in Patent Document 1, it is not necessary to demolish the existing pavement in order to correct the tilt of the concrete slab, leading to advantages in that the construction can be completed within a short period of time, whereby the traffic regulation can be removed at an early stage. However, in the case of concrete slabs on a road, at a port or airport, or the like, adjacent concrete slabs are connected at a joint part by tie bars or dowel bars. Accordingly, unless the step of injecting an expandable resin below a concrete slab tilted due to the subsidence of the joint part and expanding the resin is appropriately performed, the presence of tie bars or dowel bars causes resistance to the concrete slab pushing-up force of the expended expandable resin, leading to the situation that the concrete slabs cannot be effectively pushed up.

Thus, an object of the present invention is to provide a method for correcting the tilt of adjacent concrete slabs on subsided ground and connected at a joint part by tie bars or dowel bars caused by the subsidence of the joint part.

Means for Solving the Problems

The present invention accomplished in light of the above points is, as defined in claim 1, a method for correcting the tilt of adjacent concrete slabs on subsided ground and connected at a joint part by a tie bar and/or a dowel bar caused by the subsidence of the joint part, the method comprising a step of pushing up a tilted concrete slab by: with respect to concrete slabs adjacent to each other across a subsided joint part, drilling an injection hole for injecting an expandable resin in one concrete slab at a point 10 to 200 cm away from the joint part and also in the other concrete slab at a point 10 to 200 cm away from the joint part, the point in the other concrete slab being on a line that is orthogonal to the joint part and has the point in the one concrete slab thereon; simultaneously starting an operation of intermittently injecting an expandable resin from both of the injection holes; and expanding the expandable resin below both of the concrete slabs.

Effect of the Invention

According to the present invention, a method for correcting the tilt of adjacent concrete slabs on subsided ground and connected at a joint part by tie bars or dowel bars caused by the subsidence of the joint part can be provided.

BRIEF DESCRIPTION OF THE DRAWINGS

FIG. 1A is a schematic plan view of an example, showing a region where ground subsidence has occurred (within the dotted frame) and candidate points (●) for drilling injection holes for injecting an expandable resin in both of concrete slabs adjacent to each other across a subsided joint part.

FIG. 1B is a schematic cross-sectional view showing the tilt of both of the concrete slabs.

MODE FOR CARRYING OUT THE INVENTION

Figure 2:
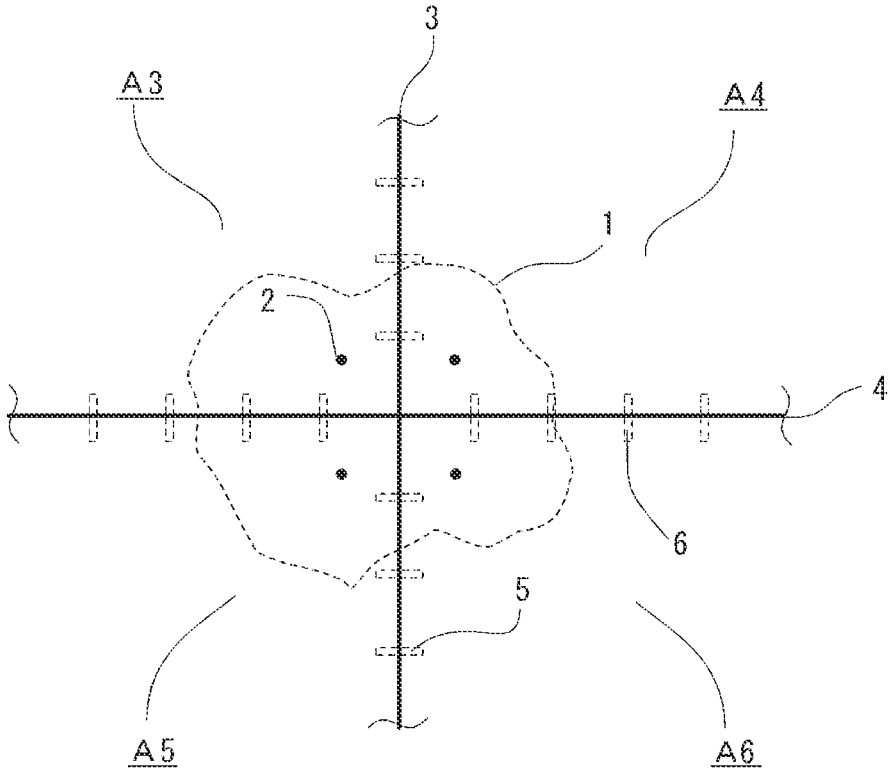
FIG. 2 is a schematic plan view of another example.

The present invention is a method for correcting the tilt of adjacent concrete slabs on subsided ground and connected at a joint part by a tie bar and/or a dowel bar caused by the subsidence of the joint part, the method comprising a step of pushing up a tilted concrete slab by: with respect to concrete slabs adjacent to each other across a subsided joint part, drilling an injection hole for injecting an expandable resin in one concrete slab at a point 10 to 200 cm away from the joint part and also in the other concrete slab at a point 10 to 200 cm away from the joint part, the point in the other concrete slab being on a line that is orthogonal to the joint part and has the point in the one concrete slab thereon; simultaneously starting an operation of intermittently injecting an expandable resin from both of the injection holes; and expanding the expandable resin below both of the concrete slabs.

Concrete slabs to which the method of the present invention is applied are each a square or rectangular slab whose sides are each 3 to 10 m, for example, and adjacent concrete slabs are connected at a joint part by 3 to 40 tie bars or dowel bars, for example. The tie bars and dowel bars may be known ones (e.g., those made of steel, 10 to 50 mm in diameter and 50 to 100 cm in length).

In the method of the present invention, it is first important that points, for drilling injection holes for injecting an expandable resin below both concrete slabs adjacent to each other across a subsided joint part, are a point 10 to 200 cm away from the joint part in one concrete slab and a point 10 to 200 cm away from the joint part in the other concrete slab, the point in the other concrete slab being on a line that is orthogonal to the joint part and has the point in the one concrete slab thereon. When the points for drilling injection holes for injecting an expandable resin are set in this way, it is possible to avoid that the presence of tie bars or dowel bars causes resistance to the concrete slab pushing-up force of the expandable resin that has been injected from the injection holes and has expanded. As a result, the tilted concrete slabs can be effectively pushed up by the expanded expandable resin. It is also acceptable that a concrete slab facing a tilted concrete slab across the joint part does not have the same degree of tilt as the tilted concrete slab or has no tilt itself (i.e., there is no need to push up the slab itself). Even in the case where a concrete slab facing a tilted concrete slab across the joint part has no tilt itself, usually, under the influence of ground subsidence, a space is present therebelow, or the ground therebelow is weak. Thus, it is necessary that an expandable resin is injected therebelow and expanded, thereby filling the space or compacting the weak ground. When points for drilling injection holes for injecting an expandable resin in both of the concrete slabs are set to be on a line orthogonal to the joint part, it can be avoided that the presence of tie bars or dowel bars causes resistance to the concrete slab pushing-up force of the expandable resin that has been injected from the injection holes and has expanded. The reasons why points for drilling injection holes for injecting an expandable resin are set to be 10 to 200 cm away from the joint part in both of the concrete slabs are as follows. When the distance from the joint part is too small, the presence of tie bars or dowel bars may cause resistance to the concrete slab pushing-up force of the expandable resin that has been injected from the injection holes and has expanded, whereby an excessive load is locally applied to the concrete slabs, resulting in cracking. In addition, the expandable resin injected from the injection holes may spout from the joint part, or the expandable resin may enter below another concrete slab opposed across the joint part and expand, thereby unnecessarily pushing up such a concrete slab, for example. Meanwhile, when the distance from the joint part is too large, the tilt of the concrete slabs is not effectively corrected by the expanded expandable resin. The distance from the joint part is preferably 20 to 150 cm, and more preferably 30 to 100 cm. The drilling of an injection hole for injecting an expandable resin may be performed using a drill, for example, in a region having a diameter of 10 to 50 mm.

In the method of the present invention, it is next important that an operation of intermittently injecting an expandable resin from the injection holes drilled in both of the concrete slabs adjacent to each other across the subsided joint part is simultaneously started, and the expandable resin is expanded below both of the concrete slabs. Unless this operation is simultaneously started, the presence of tie bars or dowel bars causes resistance to the concrete slab pushing-up force of the expandable resin that has been injected from the injection holes and has expanded, and the tilt of the concrete slabs is not effectively corrected. The operation of intermittently injecting an expandable resin from an injection hole is preferably performed as follows, for example. By handling an injection gun used to inject an expandable resin from an injection hole, the time of injecting an expandable resin (e.g. 1 to 60 seconds, normally 3 to 30 seconds) and the time of halting the injection of an expandable resin for the injected expandable resin to expand (e.g. 1 to 10 seconds, usually 2 to 5 seconds) are taken as one set, and this set is repeated. The time of injecting an expandable resin (i.e., the amount of expandable resin injected) and the time of halting the injection of an expandable resin can be suitably determined based on the degree of tilt of the concrete slabs, the properties of the expandable resin used, and the like. In the operation of intermittently injecting an expandable resin simultaneously started for both of the concrete slabs, the degree of concrete slab pushing-up per operation is, on condition that an excessive load is not locally applied to the concrete slabs, and cracking does not occur, 1 to 30 mm, preferably 3 to 20 mm, and more preferably 5 to 15 mm, which is controlled by a laser leveling machine or the like. When the degree of concrete slab pushing-up per operation of intermittently injecting an expandable resin is more than 30 mm, it is likely to happen that an excessive load is locally applied to the concrete slabs, causing cracking.

FIG. 1A is a schematic plan view of an example, showing a region 1 where ground subsidence has occurred and candidate points 2 for drilling injection holes for injecting an expandable resin into concrete slabs A1 and A2 adjacent to each other across a subsided joint part, FIG. 1B is a schematic cross-sectional view showing the tilt of the concrete slabs A1 and A2. In the situation shown in FIGS. 1A and 1B, the region 1 where ground subsidence has occurred reaches both of the adjacent concrete slabs A1 and A2 connected at a joint part (longitudinal joint) 3 by 5 tie bars 5, and both of the concrete slabs are tilted. The candidate points 2 for drilling injection holes for injecting an expandable resin below the concrete slabs A1 and A2 are to be on a line orthogonal to the joint part 3 and within a region 10 to 200 cm away from the joint part 3. The determination of points for drilling injection holes for injecting an expandable resin on a line orthogonal to the joint part 3 in the concrete slabs A1 and A2 can be suitably made based on the degree of tilt of the concrete slabs A1 and A2, the properties of the expandable resin used, and the like. The operation of intermittently injecting an expandable resin is simultaneously started, for example, from an injection hole drilled at a point A1*b* in the concrete slab A1 and from an injection hole drilled at a point A2*a* in the concrete slab A2, which are on the line of a row 2 orthogonal to the joint part 3. When the time of injecting an expandable resin is increased, the expandable resin can be expanded in a wide region, while when the time of injecting an expandable resin is reduced, the expandable resin can be expanded in a narrow region. Based on the degree of tilt of the concrete slabs A1 and A2, the properties of the expandable resin used, and the like, the combination of points for drilling injection holes may be a combination of points at different distances from the joint part 3, like the combination of the point A1*b* in the concrete slab A1 and the point A2*a* in the concrete slab A2. Alternatively, the combination may also be a combination of points at the same distance from the joint part 3 (a combination of A1*a* and A2*a* or a combination of A1*b* and A1*b*). For example, in the operation of intermittently injecting an expandable resin simultaneously started from an injection hole drilled at the point A1*b* in the concrete slab A1 and from an injection hole drilled at the point A2*a* in the concrete slab A2, the degree of concrete slab pushing-up per operation is, as described above, 1 to 30 mm on condition that an excessive load is not locally applied to the concrete slabs, and cracking does not occur. After performing these predetermined steps on the line of the row 2 orthogonal to the joint part 3 in this manner, for example, the same steps are performed on the line of a row 1 orthogonal to the joint part 3, and the same steps are further performed on the line of a row 3 orthogonal to the joint part 3. If necessary, the same steps are additionally performed again on the line of at least one of the rows 1 to 3 orthogonal to the joint part 3, or the same steps are performed on the line of another row orthogonal to the joint part 3, thereby pushing up the concrete slabs A1 and A2 to a predetermined height. Subsequently, in order to fill a space that may be present below the concrete slabs A1 and A2 pushed up to the predetermined height or compact the weak ground, an expandable resin may be injected from an injection hole separately drilled in the concrete slab and expanded. It is desirable that the injection holes from which an expandable resin has been injected are closed with unshrinkable mortar, for example.

FIG. 2 is a schematic plan view of an example, showing a region 1 where ground subsidence has occurred and candidate points 2 for drilling injection holes for injecting an expandable resin into 4 adjacent concrete slabs A3 to A6. In the situation shown in FIG. 2, the region 1 where ground subsidence has occurred reaches all of the 4 adjacent concrete slabs A3 to A6, which are connected at a joint part (longitudinal joint) 3 by tie bars 5 and at a joint part (transverse joint) 4 by dowel bars 6. The operation of intermittently injecting an expandable resin from injection holes drilled at the candidate points 2 for drilling injection holes for injecting an expandable resin below the 4 concrete slabs A3 to A6 is as described above.

The expandable resin used in the method of the present invention may be any kind as long as it can be injected into an inside of subsided ground or a space formed between the ground and a concrete slab and expanded to push up the concrete slab, and can also withstand the weight loaded on the corrected concrete slab. However, CFC-free expandable resins, which do not cause global warming and are environment-friendly, are particularly preferable. Examples of CFC-free expandable resins include commercially available products made of a polyol and an isocyanate, which react to produce urethane foam without generating CFC gas (specifically, a combination of CFC-free polyol FF5020-UC and isocyanate NP-90, both manufactured by Nihon Puftem Co., Ltd., can be mentioned). As such a CFC-free expandable resin, a polyol and an isocyanate mixed in a weight ratio of 1:0.8 to 1.5 at 20 to 70° C. can be used. Examples of CFC-free expandable resins also include, in addition to those made of a polyol and an isocyanate, a resin that produces carbon dioxide foam as a result of the reaction between water and an isocyanate, a resin that foams utilizing liquefied carbon dioxide, and a hydrocarbon-based resin having foaming characteristics.

INDUSTRIAL APPLICABILITY

According to the present invention, a method for correcting the tilt of adjacent concrete slabs on subsided ground and connected at a joint part by tie bars or dowel bars caused by the subsidence of the joint part can be provided. In this respect, the present invention is industrially applicable.

EXPLANATION OF REFERENCE NUMERALS

A1 to A6: Concrete slab

1: Region where ground subsidence has occurred (within dotted frame)

2, A1*a*, A1*b*, A2*a*, A2*b*: Candidate point for drilling injection hole for injecting expandable resin

3: Joint part (longitudinal joint)

4: Joint part (transverse joint)

5: Tie bar

6: Dowel bar (slip bar)

The invention claimed is:

1. A method for correcting the tilt of adjacent concrete slabs on subsided ground and connected at a joint part by a tie bar and/or a dowel bar caused by the subsidence of the joint part, the method comprising a step of pushing up a tilted concrete slab by:

with respect to concrete slabs adjacent to each other across a subsided joint part, drilling an injection hole for injecting an expandable resin in one concrete slab at a point 10 to 200 cm away from the joint part and also in the other concrete slab at a point 10 to 200 cm away from the joint part, the point in the other concrete slab being on a line that is orthogonal to the joint part and has the point in the one concrete slab thereon; and simultaneously starting an operation of intermittently injecting an expandable resin from both of the injection holes, wherein the expandable resin expands below both of the concrete slabs, and then, the tilt of the concrete slabs is corrected by pushing-up force of the expandable resin without an excessive load being locally applied to the concrete slabs causing cracking, wherein each of the concrete slabs is a square or rectangular slab having sides each being 3 to 10 meters, wherein the adjacent concrete slabs are connected at the joint part by 3 to 40 tie bars or dowel bars, and wherein the degree of concrete slab pushing-up per operation is 30 mm or less, and the intermittent injecting of the expandable resin corresponds to a set of injecting for 1 to 60 seconds and halting injection for 1 to 10 seconds, and the set is repeated.

2. The method according to claim 1, wherein the method for correcting the tilt of the adjacent concrete slabs uses only the expandable resin to push up the concrete slabs and does not use a lifting mechanism.

3. A method for correcting the tilt of adjacent concrete slabs on subsided ground and connected at a joint part by a tie bar and/or a dowel bar caused by the subsidence of the joint part, the method comprising a step of pushing up a tilted concrete slab by:

with respect to concrete slabs adjacent to each other across a subsided joint part, drilling an injection hole for injecting an expandable resin in one concrete slab at a point 10 to 200 cm away from the joint part and also in the other concrete slab at a point 10 to 200 cm away from the joint part, the point in the other concrete slab being on a line that is orthogonal to the joint part and has the point in the one concrete slab thereon; and simultaneously starting an operation of intermittently injecting an expandable resin from both of the injection holes, wherein the expandable resin expands below both of the concrete slabs, and then, the tilt of the concrete slabs is corrected by pushing-up force of the expandable resin without any other load being locally applied to the concrete slabs, wherein each of the concrete slabs is a square or rectangular slab having sides each being 3 to 10 meters, wherein the adjacent concrete slabs are connected at the joint part by 3 to 40 tie bars or dowel bars, and wherein the degree of concrete slab pushing-up per operation is 30 mm or less, and the intermittent injecting of the expandable resin corresponds to a set of injecting for 1 to 60 seconds and halting injection for 1 to 10 seconds, and the set is repeated.

4. The method according to claim 3, wherein the method for correcting the tilt of the adjacent concrete slabs uses only the expandable resin to push up the concrete slabs and does not use a lifting mechanism.

* * * * *